United States Patent [19]

Schnyder

[11] 4,431,036

[45] Feb. 14, 1984

[54] MECHANISM FOR BRAKING A WEFT YARN IN A WEAVING MACHINE

[75] Inventor: Markus Schnyder, Elsau-Raterschen, Switzerland

[73] Assignee: Sulzer Brothers Limited, Winterthur, Switzerland

[21] Appl. No.: 338,099

[22] Filed: Jan. 8, 1982

[30] Foreign Application Priority Data

Jan. 30, 1981 [CH] Switzerland ..... 608/81

[51] Int. Cl.[3] ..... D03D 47/34

[52] U.S. Cl. ..... 139/429; 139/194

[58] Field of Search ..... 139/429, 439, 450, 194; 226/195; 188/65.1, 65.2, 65.3; 242/149, 150; 66/125, 145

[56] References Cited

U.S. PATENT DOCUMENTS

| | | | |
|---|---|---|---|
| 2,819,736 | 1/1958 | Pfarrwaller | 139/194 |
| 3,797,532 | 3/1974 | Haltmeier | 139/194 |
| 3,929,169 | 12/1975 | Pfarrwaller | 139/429 |

*Primary Examiner*—Henry Jaudon

*Attorney, Agent, or Firm*—Kenyon & Kenyon

[57] ABSTRACT

The flexible brake band is mounted between a fixed bracket and a movable carrier. The carrier has an arm which is telescopically mounted within a tubular arm mounted on the bracket and is biased by a spring away from the bracket. An adjustment screw is provided to adjust the tension of the spring and, hence, the brake band.

10 Claims, 1 Drawing Figure

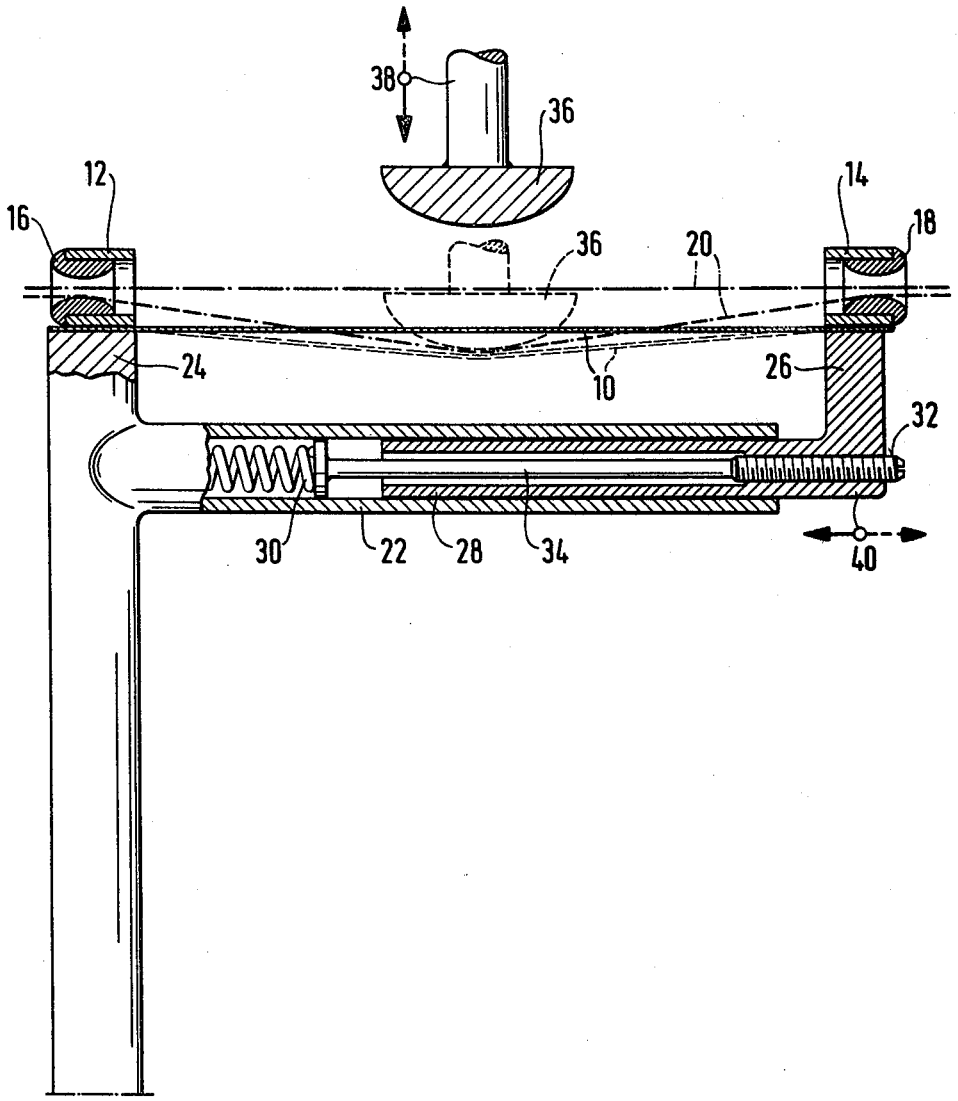
38
36
12
14
16
18
36
20
24
10
26
32
30
22
28
34
40

MECHANISM FOR BRAKING A WEFT YARN IN A WEAVING MACHINE

BACKGROUND OF THE INVENTION

This invention relates to a mechanism for braking a weft yarn in a weaving machine. More particularly, this invention relates to a a mechanism employing a flexible brake band for braking a weft yarn in a weaving machine.

Heretofore, various types of mechanisms have been employed for the braking of a weft yarn in a weaving machine. For example, as described in Swiss Pat. No. 497,576, one known mechanism employs a flexible brake band having ends which are secured to carrier means in the form of pivotably mounted arms as well as a brake member for pressing a weft yarn against the brake band. In addition, a tension spring is used to return the pivotably mounted arms of the carrier means. However, a disadvantage of this mechanism is that the pivotable mounting of the carrier arms is complicated and requires a considerable amount of space. Further, relatively large masses have to be moved. Another disadvantage is that the pivotable parts and the tension spring are susceptible to soiling by flying dust. This, in turn, impairs the operation of the mechanism.

Accordingly, it is an object of the invention to provide a braking mechanism of simple and compact construction which is reliable in operation.

It is another object of the invention to improve the reliability of a weft yarn braking mechanism employing a flexible brake band.

Briefly, the invention provides a mechanism for braking a weft yarn in a weaving machine which employs a flexible brake band, means for guiding a weft yarn over the brake band and at least one brake member for pressing the weft yarn against the brake band. In accordance with the invention, the mechanism has at least one linearly movable carrier which mounts the brake band thereon and a return means for displacing the carrier during pressing of the weft yarn against the brake band. The mechanism is relatively compact and is of simple construction with relatively small moving masses. Further, the accumulation of dust does not have any appreciable effect on the function of the yarn brake.

In order to provide a particularly effective protection of the mounting against dust, the carrier can be telescopically mounted in a sleeve.

The return means may be in the form of a compression spring which is also mounted in the sleeve. This provides practically complete encapsulation of the return means.

In addition, the compression spring may engage an adjusting screw which is mounted in the carrier and which engages the spring. This screw may be used to make very simple adjustments in the compression force of the spring.

These and other objects and advantages of the invention will become more apparent from the following detailed description taken in conjunction with the drawing wherein:

The FIGURE illustrates a partial sectional view in side elevation of a braking mechanism according to the invention.

Referring to the drawing, the braking mechanism includes a flexible brake band 10 which is mounted at one end in a bracket 24 and at the opposite end in a carrier 26. As indicated, the bracket 24 carries a tubular arm 22 which extends outwardly while the carrier 26 is in the form of an angle member having an arm 28 slideably or telescopically mounted within the tubular arm 22.

A means is also provided within the tubular arm 22 for biasing the carrier 26 away from the bracket 24 in order to tension the brake band 10. As indicated, this means is in the form of a compression spring 30.

An adjusting screw 34 passes through the carrier arm 28 and abuts the spring 30 in the form of a piston. The adjusting screw 34 also has a thread 32 which is threaded into the carrier arm 28. As indicated, the exposed end of the screw 34 is formed so as to permit turning via a suitable tool in order to adjust the screw 34 within the carrier arm 28.

The braking mechanism also has a means for guiding a weft yarn 20 over the brake band 10. This means includes a pair of eye holders 12, 14 which are mounted on the bracket 24 and carrier 26, respectively. Each holder 12, 14 has an eye 16, 18 for passage of the weft yarn 20 as indicated in chain-dotted line. In addition, a brake member 36 in the form of a plunger is disposed above the brake band 10 for pressing the weft yarn 20 against the brake band 10. As indicated, the brake member 36 is movable in the direction indicated by the arrow 38.

During operation, the brake member 36 moves from the full line position into the chain-dotted line position in order to press the weft yarn 20 against the brake band 10 for braking purposes. At this time, the carrier 26 is movable linearly in the direction indicated by the arrow 40 against the bias of the compression spring 30. Thus, the spring 30 serves to keep the brake band 10 tensioned.

Of note, the tension of the compression spring 30 and, hence, of the brake band 10 can be adjusted from time to time by adjusting the screw 34 within the carrier 26.

The invention thus provides a simple and compact braking mechanism for the braking of a weft yarn in a weaving machine. Further, by slideably mounting the carrier within a tubular arm of the bracket, dust and the like can be prevented from soiling the encapsulated compression spring 30.

What is claimed is:

1. A mechanism for braking a weft yarn in a weaving machine, said mechanism comprising a flexible brake band;

means for guiding a weft yarn over said brake band;

at least one brake member for pressing the weft yarn against said brake band;

at least one linearly movable carrier mounting said brake band thereon; and a return means for displacing said carrier during pressing of the weft yarn against said brake band.

2. A mechanism as set forth in claim 1 which further comprises a sleeve having said carrier telescopically mounted therein.

3. A mechanism as set forth in claim 2 wherein said return means is a compression spring mounted in said sleeve.

4. A mechanism as set forth in claim 3 which further comprises an adjusting screw mounted in said carrier and engaging said spring.

5. A mechanism for braking a weft yarn in a weaving machine, said mechanism comprising a flexible brake band;

a bracket mounting one end of said brake band thereon;

a linearly movable carrier mounting an opposite end of said brake band thereon;

means for guiding a weft yarn over said brake band;

at least one brake member for pressing the weft yarn against said brake band; and means biasing said carrier away from said bracket to tension said brake band.

6. A mechanism as set forth in claim 5 wherein said bracket includes a tubular arm and said carrier includes an arm slidably mounted within said tubular arm.

7. A mechanism as set forth in claim 6 wherein said biasing means is a compression spring mounted within said tubular arm and abutting said carrier arm.

8. A mechanism as set forth in claim 7 which further comprises an adjusting screw threaded through said carrier arm and abutting said spring for adjusting the tension in said brake band.

9. A mechanism for braking a weft yarn in a weaving machine, said mechanism comprising a flexible brake band;

a bracket mounting one end of said brake band thereon and having a tubular arm extending therefrom a carrier slidably mounted in said tubular arm and mounting an opposite end of said brake band thereon;

means for guiding a weft yarn over said brake band;

at least one brake member for pressing the weft yarn against said brake band; and means within said tubular arm biasing said carrier away from said bracket to tension said brake band; and means within said tubular arm biasing said carrier away from said bracket to tension said brake band.

10. A mechanism as set forth in claim 9 wherein said biasing means is a compression spring mounted within said tubular arm and abutting said carrier and which further comprises an adjusting screw threaded through said carrier and abutting said spring for adjusting the tension in said brake band.

* * * * *